US006971389B2

(12) United States Patent
Collins

(10) Patent No.: US 6,971,389 B2
(45) Date of Patent: Dec. 6, 2005

(54) PORTABLE MASK FOR DETAINEE

(76) Inventor: Jason Collins, 12582 Dale Ct., Broomfield, CO (US) 80020

( * ) Notice: Subject to any disclaimer, the term of this patent is extended or adjusted under 35 U.S.C. 154(b) by 0 days.

(21) Appl. No.: 10/762,080

(22) Filed: Jan. 20, 2004

(65) Prior Publication Data

US 2005/0155606 A1 Jul. 21, 2005

(51) Int. Cl.[7] ..... A62B 18/08

(52) U.S. Cl. ..... 128/206.29; 128/206.21; 128/206.27; 128/207.11; 128/206.19; 128/857; 2/424

(58) Field of Search ..... 128/206.21, 206.24, 128/206.27, 207.11, 206.29, 200.27, 200.28, 128/206.19, 857; 2/424, 427, 428

(56) References Cited

U.S. PATENT DOCUMENTS

| | | | | | |
|---|---|---|---|---|---|
| 145,337 | A | * | 12/1873 | Crofutt | 128/206.19 |
| 319,338 | A | * | 6/1885 | Southwell | 128/863 |
| 652,196 | A | * | 6/1900 | Shibe | 2/9 |
| 1,150,991 | A | * | 8/1915 | Britton | 128/206.19 |
| 2,038,310 | A | * | 4/1936 | Panettiere | 128/863 |
| 2,566,557 | A | * | 9/1951 | Danielson | 128/863 |
| 2,775,967 | A | * | 1/1957 | Sovinsky | 128/206.12 |
| 3,058,463 | A | * | 10/1962 | Goodrich, Jr. | 128/863 |
| 3,249,108 | A | * | 5/1966 | Terman | 128/204.17 |
| 4,719,911 | A | * | 1/1988 | Carrico | 128/206.29 |
| 4,827,923 | A | * | 5/1989 | Bishop et al. | 128/206.11 |
| 5,058,211 | A | * | 10/1991 | Hanks | 2/206 |
| 5,099,525 | A | * | 3/1992 | Millauro | 2/9 |
| 5,431,158 | A | * | 7/1995 | Tirotta | 128/206.21 |
| 5,538,014 | A | * | 7/1996 | Wilson et al. | 128/863 |
| 5,570,705 | A | * | 11/1996 | Burke | 128/869 |
| 5,595,174 | A | * | 1/1997 | Gwaltney | 128/201.15 |
| 5,664,262 | A | * | 9/1997 | Cominsky | 2/202 |
| 5,706,802 | A | * | 1/1998 | McCormick | 128/204.17 |
| 5,765,556 | A | * | 6/1998 | Brunson | 128/206.19 |
| 5,785,052 | A | * | 7/1998 | Johnson | 128/830 |
| 6,145,504 | A | * | 11/2000 | Miyake | 128/206.19 |
| 6,374,829 | B1 | * | 4/2002 | Chapman | 128/857 |
| 6,464,924 | B1 | * | 10/2002 | Thornton | 264/331.12 |

OTHER PUBLICATIONS

PX Direct "Protective Mask", "Transport Hood", "Capture Hood", and Spit Net, www.pxdirect.com/Restraints-Head.htm (Earliest date unknown).

* cited by examiner

*Primary Examiner*—Mital Patel
(74) *Attorney, Agent, or Firm*—Gordon & Rees LLP

(57) ABSTRACT

A protective mask for resisting biting by a detainee has a panel of flexible, breathable material shaped to extend across and cover the nose, mouth and cheeks of a wearer and at least one fastener strap extending between the opposite sides of the panel for extending around the back of a wearer's head in order to secure the panel in position across a wearer's face. An elongate bite-resisting strip member is secured to the central region of the inner face of the panel to extend transversely across the mouth. This will resist or prevent biting by the wearer through the material of the panel. A central folded region of the panel creates a space between the panel and the wearer's mouth, the folded region being open at the lower edge of the panel to prevent pooling of vomit or the like within the mask.

23 Claims, 5 Drawing Sheets

PORTABLE MASK FOR DETAINEE

BACKGROUND OF THE INVENTION

The present invention relates generally to a mask for covering the mouth and nose of a person detained by the authorities, and is particularly concerned with a mask for use in reducing or avoiding the risk of a detainee biting or spitting on a police or military officer.

Police and military personnel encounter a wide variety of people they must restrain and detain. Unfortunately, many of these detainees are very uncooperative and resistant, even after being handcuffed or otherwise restrained. Officers often must handle detainees who attempt to bite or spit on the officer, and have legitimate concerns about the possibility of bodily-fluid borne diseases such as HIV, hepatitis, and others. Officers find that many difficult detainees are under the influence of drugs or alcohol. Such people often vomit, creating a concern of contact with the body fluid.

Hoods and nets that fit over a detainee's head have been used for years by police departments and the military for handling uncooperative detainees. Many of these hoods do not protect the officer from biting and they do not have a space to allow body fluids, such as vomit, to escape the detainee's mouth and nose area, thus creating a choking hazard. Furthermore, they are not easily portable and thus are unlikely to be with the officer at the times needed. The "Protective Mask", for example, (www.pxdirect.com/Restraints-Head.htm), is made of a polyurethane material that is cumbersome and not likely to be carried by an officer on his or her duty belt. If the Protective Mask is in the patrol car, the officer is unlikely to have the time or the ability to leave the detainee to go retrieve the mask. The Protective Mask further does not have an opening to allow for downward drainage of body fluid, such as vomit. The polyurethane material is hard and could be easily hooked by the detainee on an object, thus removing or re-adjusting the mask.

Other options available to officers include the "Transport Hood" (www.pxdirect.com/Restrains-head.htm), which fits around a detainee's neck and does not have a solid fabric covering the detainee's nose, thus allowing potential fluid transfer from the detainee's nose. The "Capture Hood" (www.pxdirect.com/Restraints-Head.htm) is comprised of heavy-weight Cordura fabric that completely covers the head and gathers around the detainee's neck. This hood would gather excreted body fluids and completely blocks the detainee's vision. The "Spit Net" (www.pxdirect.com/Restraints-Head.htm) fits from the top of the detainee's head to around the armpits, which is much too large for an officer to carry on his or her person. None of these hoods or masks provides an additional piece over the detainee's mouth to prevent biting.

U.S. Pat. No. 5,570,705 of Burke describes a facial restraint for an incarcerated person which is intended to prevent biting and spitting. The device basically comprises a mask extending over the face and nose and under the chin of the individual, along with straps for extending from the mask around the rear of the individual's head. The mask has air holes for permitting nose and mouth breathing, but may present a choking hazard since there is no provision for vomit to escape the mask. The mask is made entirely of thin flexible and elastic material, and it appears that the individual could potentially bite someone through this material.

Officers wishing to avoid bites and body fluid also require that the mask is small, flexible, lightweight, and disposable.

A mask must be available to the officer quickly and easily, as time is always of the essence when dealing with a difficult detainee.

SUMMARY OF THE INVENTION

It is an object of the present invention to provide a new and improved mask for placement over the mouth and nose of a detainee.

According to the present invention, a mask is provided, which comprises a panel of flexible, breathable material shaped to extend across and cover the nose, mouth and cheeks of a wearer and having opposite sides for positioning adjacent the ears of the wearer, and at least one fastener strap extending between the opposite sides of the panel for extending around the back of a wearer's head in order to secure the panel in position, the panel having an outer face, an inner face for facing towards the wearer when worn, an upper edge, a lower edge, and a central region which is folded to provide a tented, open region below the nose and over the mouth of the wearer, the tented region being open at the lower edge of the panel to allow escape of body fluids.

The mask is a portable mask made of breathable, flexible fabric, such as, but not limited to, cotton or polyester. A rubber bite sponge is secured to the inner face of the panel to extend across the mouth of the wearer and prevent the detainee from biting. Elastic straps secure the mask to the detainee's face.

The mask will prevent a detainee from biting the officer, yet allows body fluids excreted from the nose and mouth, such as vomit, to escape via the tented region with an open lower end. Thus, vomit and other body fluids will not gather in the mask where such fluids may otherwise result in a choking hazard. The mask is small and compact, easy for an officer to apply and disposable after use.

When applied, the mask extends across the bridge of the nose and across the mouth, over the cheeks, and towards the ears. The mask folds in the center in a tent-like manner creating a cover over the mouth. The fold may be held in place by a strip of elastic material extending between opposing inner regions of the panel. The opening created leads from the mouth and past the chin, creating a space which points downward. The fabric covering the detainee's face prevents the suspect from spitting on the officer. The opening extends toward the chest, so that excessive spit and vomit does not pool inside the mask. The fabric over the mouth is loose, allowing for free breathing, and a large opening towards the chest is created when vomiting occurs.

In an exemplary embodiment, upper and lower elastic straps are provided to secure the mask across a wearer's face. The upper elastic strap extends through the mask and, when applied to the detainee, extends across the bridge of the nose, over the ears, and behind the head, so that the mask is held closely against the wearer's face in the region of the bridge of the nose. The lower strap is attached to the mid-section of the mask and connects to the upper strap, behind the detainee's ears. The elastic straps are expandable and fit all head sizes, eliminating the need for hooks. The close fit of the straps, along with the flexible fabric, makes the mask difficult for a detainee to remove. The interior elastic strap that creates the tent-like opening expands to the correct size of the detainee's head and creates the proper opening section over the mouth.

The sponge rubber bite sponge is placed length-wise down the mask at a place crossing the detainee's mouth in a direction transverse to the mouth, so as to prevent any attempt to bite through the mask. The bite sponge also provides a lining for any excreted body fluid flowing out of the mask and may be used as a handle for the officer to hold while pulling the elastic straps over the detainee's head.

The mask folds to fit into an approximately three inch by two inch portable key chain pouch, which an officer can carry on patrol car keys or duty belt. It is disposable after use. The invention further allows for any body fluids such as vomit or blood from the detainee's mouth to run down to the detainee's chest. The invention is small, compact, and lightweight, thus making it portable and easily accessible by the officer.

BRIEF DESCRIPTION OF THE DRAWINGS

The invention will be better understood from the following detailed description of an exemplary embodiment of the invention, in conjunction with the accompany drawings, in which like reference numerals refer to like parts, and in which.

DETAILED DESCRIPTION OF THE DRAWINGS

Figure 1:
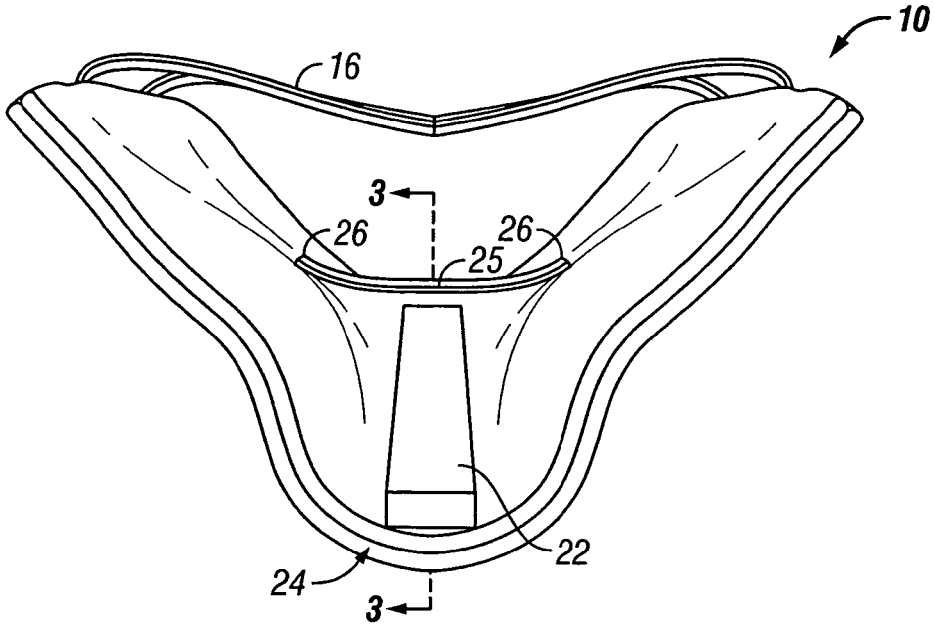
FIG. 1 is a bottom view of a mask according to an exemplary embodiment of the invention.
Figure 2:
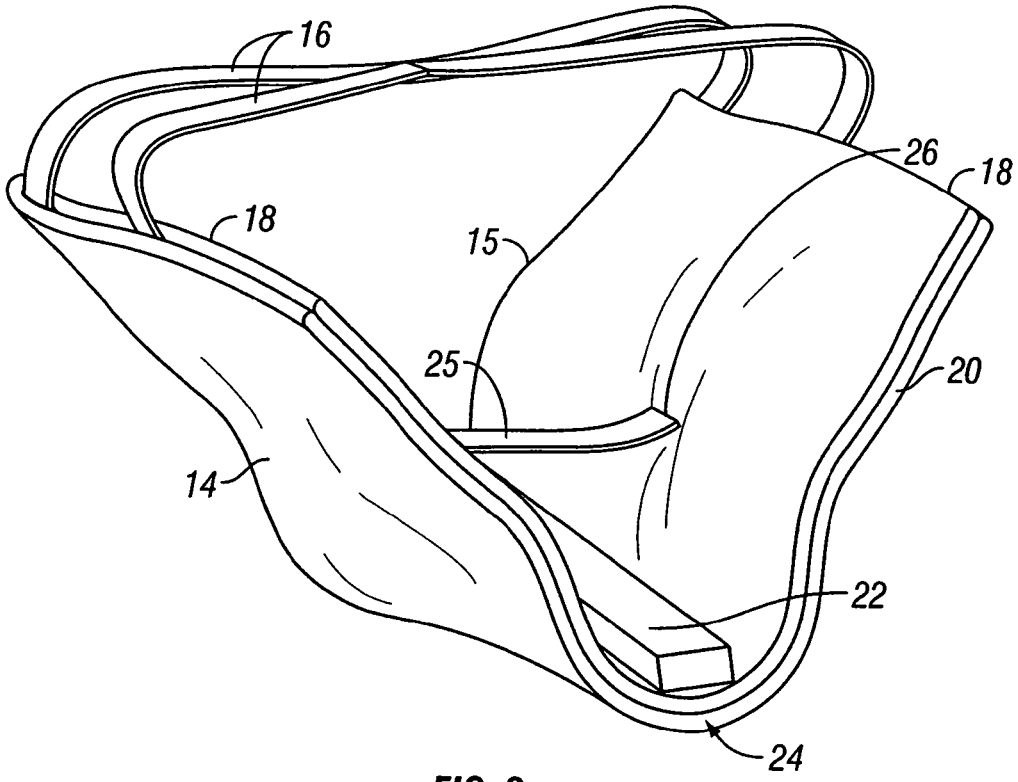
FIG. 2 is a perspective view of the mask of FIG. 1.
Figure 3:
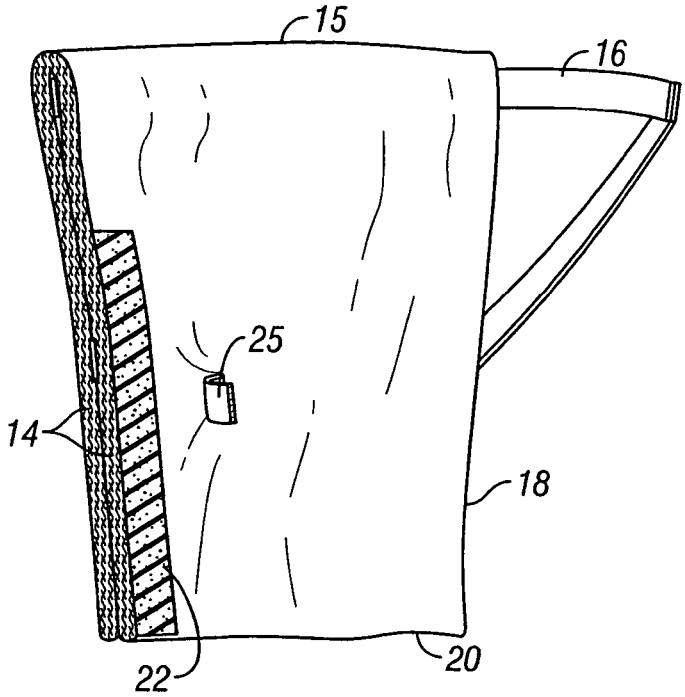
FIG. 3 is a section on the lines 3—3 of FIG. 1.
Figure 4:
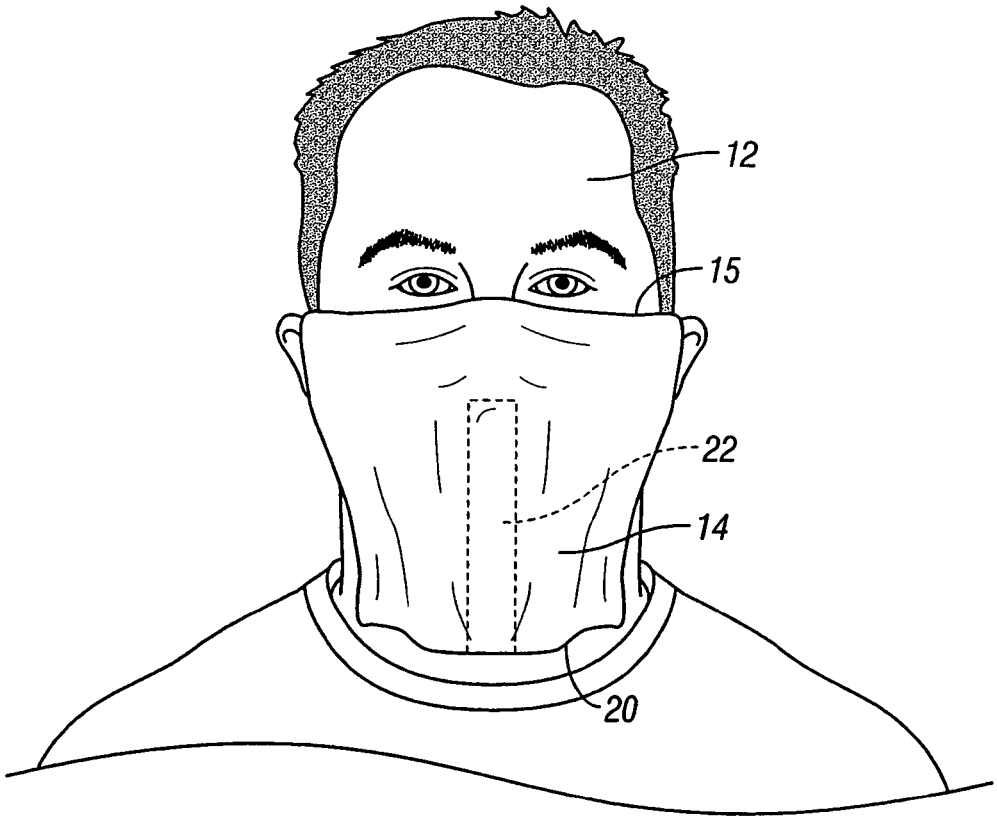
FIG. 4 is a front elevation view of the head of a person wearing the mask of FIGS. 1 and 2.

FIGS. 1 to 3 of the drawings illustrate a protective mask 10 according to an exemplary embodiment of the invention for resisting or preventing a wearer from spitting on, or biting, another individual, such as a police officer or other security officer. FIGS. 4 to 7 illustrate the mask 10 in position covering the nose and mouth of an individual 12 who has been detained by a police or military officer, or other security officer.

The mask 10 basically comprises a panel or sheet 14 of a flexible, breathable fabric or other material such as cotton, polyester, cotton/polyester blends, or the like which is folded in half lengthwise along an upper edge 15 of the mask to form a double layer construction of generally rectangular shape, and elastic straps 16 extending between opposite sides of the mask for use in securing the mask about a wearer's head. The sides 18 and lower edges 20 of the folded layers of material may be suitably secured together by stitching, adhesive, or the like. Although a double layer construction for added reinforcement is illustrated, it will be understood that the mask may be a single layer of material in alternative embodiments.

The elastic straps 16 may be simply secured by sewing or the like to the opposite sides 18 of the mask panel. However, in the illustrated embodiment, the upper strap extends through the folded upper portion of the panel and around the rear of the panel between the opposite sides 18. The lower strap has opposite ends secured to opposite sides of the panel at a location spaced below the upper strap and attaches to a central region of the upper strap. The elastic straps are expandible to fit all head sizes, eliminating the need for releasable fastener means such as clips, snaps, or the like, which would be awkward and require extra time for an officer to secure.

A bite strip 22 of sponge rubber or similar material is secured to the central region of the inner face of the mask to extend lengthwise in a generally vertical direction from the lower edge towards the upper edge when the mask is worn, as best illustrated in FIGS. 1 and 3. Strip 22 may be secured by stitching, staples, adhesive, or any other suitable fastener means. The mask panel 14 has a central folded or pleated portion 24 extending vertically between the upper and lower edges of the masks. The fold 24 is held in its folded condition via a short strip 25 of elastic material secured at its opposite ends 26 to opposing inner portions of the inner face of the mask. This will form a tented region or space 28 in front of the wearer's nose and mouth when the mask is worn, as in FIGS. 4 to 7.

When the mask is needed to prevent a combative detainee from biting or spitting on an officer, the officer simply grips the mask at the center with one hand, using the bite strip 22 as a handle, and places the mask in front of the detainee's face while gripping the straps 16 with the other hand and stretching them around the back of the detainee's head 12. The mask can therefore be positioned very quickly and easily. When positioned correctly as in FIGS. 4 to 7, the upper edge 15 of the mask will extend across the bridge of the wearer's nose and over the wearer's cheeks towards the ears, and will be held closely against the wearer's face by the upper elastic fastener strap 16. The remainder of the mask panel then extends downwardly to a location below the chin, extending over the nose and mouth region, with the bite strip 22 extending across the wearer's mouth, as indicated in dotted outline in FIG. 4. This will effectively prevent any attempt by the wearer to bite through the material of the mask.

Figure 5:
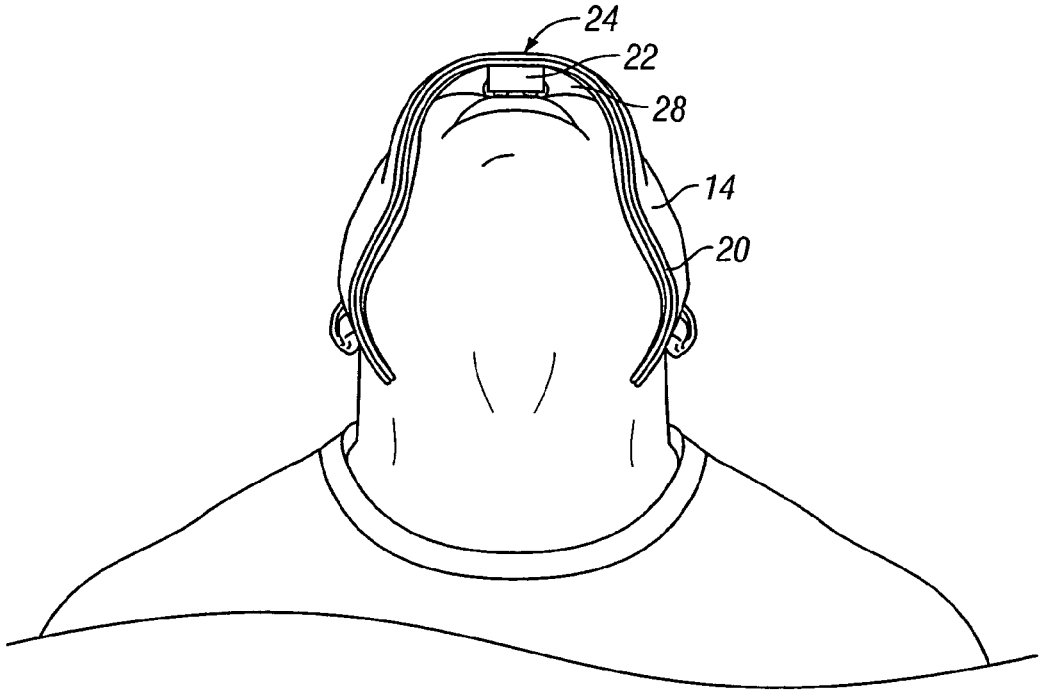
FIG. 5 is a bottom view of the mask as worn in FIG. 4, taken from below the wearer's chin.
Figure 6:
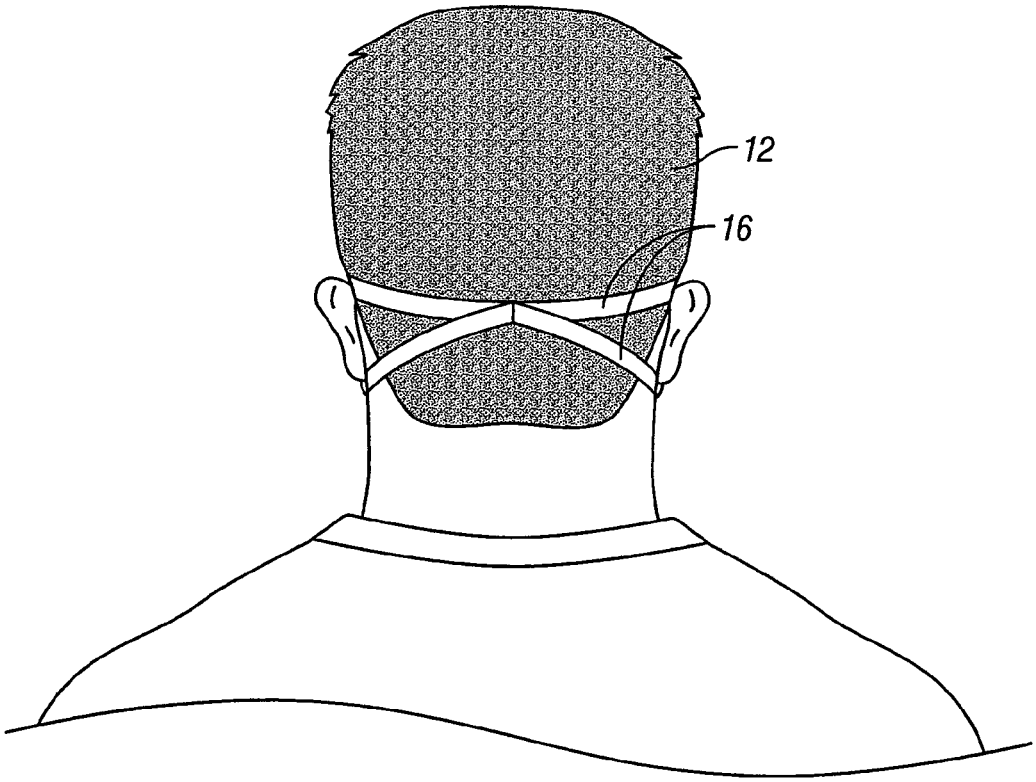
FIG. 6 is a rear elevation view of the mask wearer's head, showing the securing straps.
Figure 7:
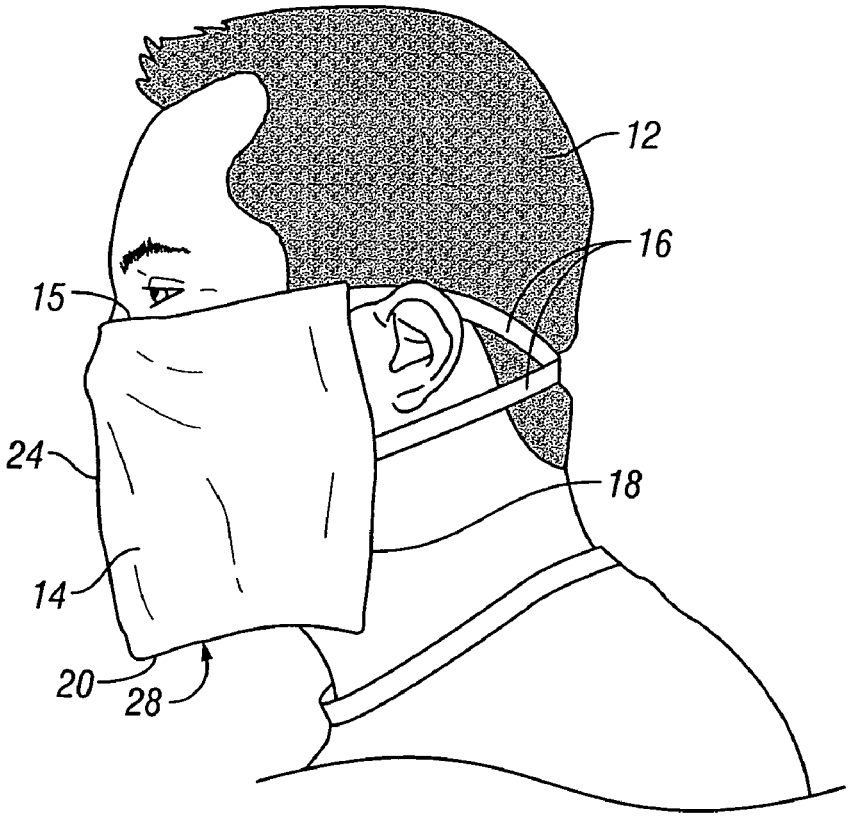
FIG. 7 is a side elevation view of the mask wearer's head.

The fold 24 formed by elastic strip 25 will form a tented or open region 28 in front of the wearer's mouth, extending from the lower end of the wearer's nose to the lower edge 20 of the mask, as best illustrated in FIG. 5, and forming an open lower end at the center of the mask. This will allow the wearer to breath more freely than if the mask was secured tight across their nose and mouth, while still serving to protect an officer against spitting or biting. The open region 28 is directed downwardly towards the wearer's chest, so that excessive spit or vomit will not pool within the mask, where it could potentially cause a choking hazard. Because of the fold 24 and resultant tented region, the portion of the mask over the wearer's mouth is loose, allowing for free breathing. The open region is directed towards the chest, so that any body fluids such as saliva, blood or vomit will flow downwardly out of the mask and onto the wearer's chest, and will not be directed towards the officer or other personnel in the area. Unlike many prior art bite prevention masks, excessive vomit cannot pool inside this mask, where it would cause a potential choking or asphyxiation risk. The sponge rubber bite strip 22 extends from the wearer's nose, across the mouth, and down to the chin, helping to prevent a wearer from biting anyone through the mask.

Figure 8:
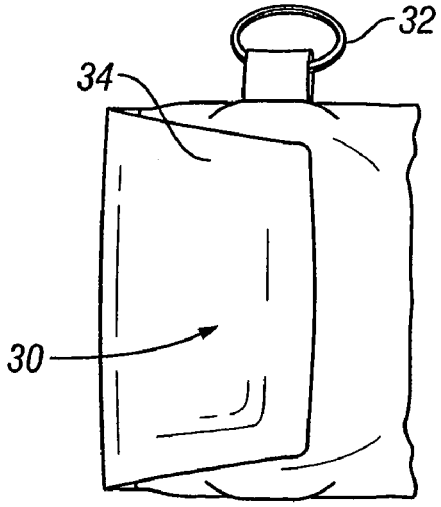
FIG. 8 is a front elevation view of a portable key chain pouch for holding the mask prior to use.
Figure 9:
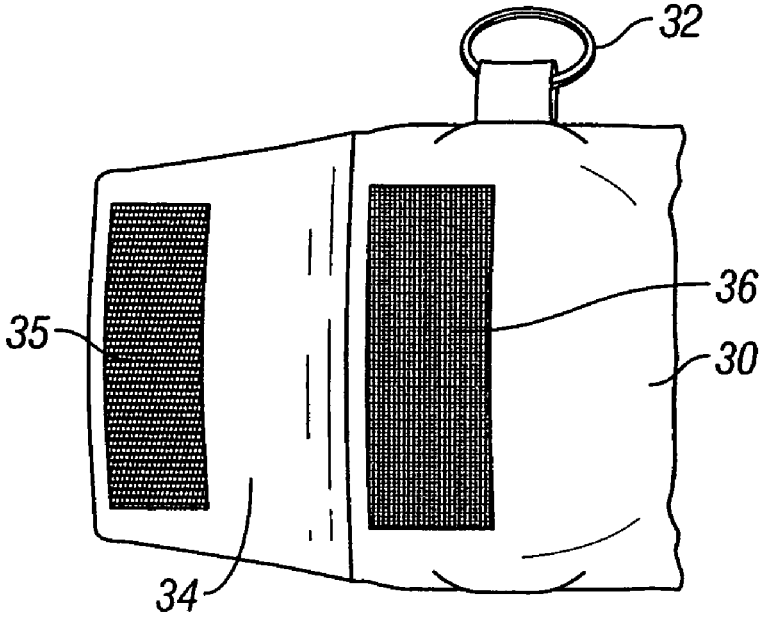
FIG. 9 is a front elevation view of the pouch of FIG. 8, shown in the open position.
Figure 10:
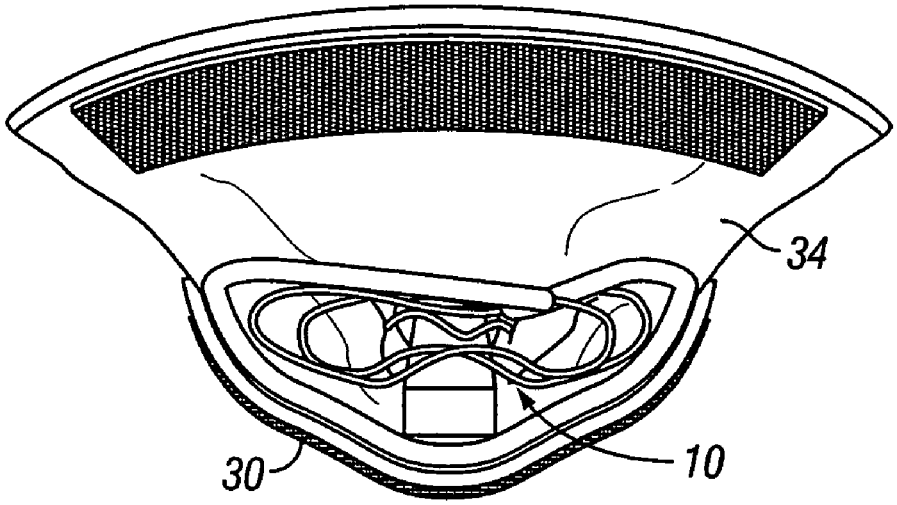
FIG. 10 is a top view of the open pouch of FIG. 9, illustrating a folded mask in position within the pouch.

The mask is small, light weight and portable, so that it can readily be carried by an officer at all times. FIGS. 8 to 10 illustrate a suitable key chain pouch 30 which may be used to hold the mask 10 until it is needed. An officer may carry pouch 30 on his key ring or duty belt, via ring 32. The pouch 30 has a closure flap 34 secured in a closed position via Velcro® or hook and loop type material patches 35,36, or any other suitable fasteners. FIG. 10 illustrates the mask 10 folded up into a compact configuration and placed inside the pouch 30.

The mask panel 14 is of suitable dimensions for completely covering the lower portion of a wearer's face, from the bridge of the nose downwards. In an exemplary embodiment, the dimensions of panel 14 were approximately 10.5 inches by 6 inches, while the length of the upper fastener strap 16 outside the mask for extending about the back of the wearer's head was of the order of 8 to 9 inches when in an unstretched condition. The length of the fold-forming elastic strip 25 was of the order of 1.5 to 2 inches. The key chain pouch dimensions were approximately three inches by two inches.

The portable mask of this invention is lightweight, readily portable, and inexpensive, and is designed to be discarded after use. An officer can easily carry the mask inside the pouch 30 on their key ring or duty belt, or even in a pocket. When a suspect is apprehended and restrained with handcuffs or the like, the officer can easily retrieve and unfold the mask, and position it over the suspect's face with the straps 16 extending securely around the rear of the suspect's head, as in FIGS. 4 to 7. The officer and other nearby individuals will then be protected against injury or contamination as a result of biting or spitting. At the same time, the detainee will still be able to breathe easily and comfortably, and the risk of accidental choking or the like in the event of vomiting is less than with prior art masks or bite restraints which fitted closely about the face. The mask is made of a breathable fabric, so that the wearer will still be able to breath even if the mask accidentally becomes squashed or stretched flatter against the face.

Although an exemplary embodiment of the invention has been described above by way of example only, it will be understood by those skilled in the field that modifications may be made to the disclosed embodiment without departing from the scope of the invention, which is defined by the appended claims.

I claim:

1. A protective mask for resisting biting by a detainee, the mask comprising:

a panel of flexible, breathable material shaped to extend across and cover the nose, mouth and cheeks of a wearer;

the panel having an upper edge for extending across the bridge of a wearer's nose, a lower edge for locating at or below a wearer's chin, opposite sides for positioning adjacent the ears of the wearer, an inner face for facing towards a wearer's face, and an outer face;

at least one fastener strap extending between the opposite sides of the panel for extending around the back of a wearer's head in order to secure the panel in position across a wearer's face;

the panel having a central region which is folded about an axis extending from the lower edge towards the upper edge of the panel to provide a tented, open region facing a wearer's face and extending below the nose and over the mouth of the wearer, the tented region being open at the lower edge of the panel to allow escape of body fluids; and an elongate strip member secured to the central region of the inner face of the panel oriented to extend transversely across the mouth of the wearer and resisting biting by the wearer through the panel.

2. The mask as claimed in claim 1, wherein the panel is of a breathable, flexible fabric material to allow external air to freely enter the chamber.

3. The mask as claimed in claim 1, wherein the strip member extends from the lower edge towards the upper edge of the panel.

4. The mask as claimed in claim 1, wherein the strip member is of sponge rubber material.

5. The mask as claimed in claim 1, wherein the strip member is of more rigid material than the panel.

6. The mask as claimed in claim 1, wherein the fastener strap is of elastic strip material.

7. The mask as claimed in claim 1, including two spaced fastener straps extending from each side of the panel.

8. The mask as claimed in claim 1, wherein at least one fastener strap extends between opposite sides of the panel at locations adjacent the upper edge of the panel, whereby the upper edge of the panel is held closely against the wearer's face when the mask is worn.

9. The mask as claimed in claim 8, wherein the lower edge of the panel hangs free and unsecured when the mask is worn.

10. The mask as claimed in claim 1, wherein the panel comprises two layers of material secured together around at least the upper, lower and side edges of the panel.

11. The mask as claimed in claim 10, wherein the panel is formed from a single sheet of material folded in half lengthwise to form said two layers.

12. The mask as claimed in claim 11, wherein the fastener strap comprises an elastic member extending between the two layers of material across the upper edge of the panel and outwardly from opposite sides of the panel for extending around the back of the wearer's head.

13. The mask as claimed in claim 12, including at least one additional elastic member extending between opposite sides of the panel at a location spaced below said upper edge.

14. A protective mask for resisting biting by a detainee, the mask comprising:

a panel of flexible, breathable material shaped to extend across and cover the nose, mouth and cheeks of a wearer;

the panel having an upper edge for extending across the bridge of a wearer's nose, a lower edge for locating at or below a wearer's chin, opposite sides for positioning adjacent the ears of the wearer, an inner face for facing towards a wearer's face, and an outer face;

at least one fastener strap extending between the opposite sides of the panel for extending around the back of a wearer's head in order to secure the panel in position across a wearer's face; and the panel having a central region which is folded about an axis extending from the lower edge towards the upper edge of the panel to provide a tented, open region facing a wearer's face and extending below the nose and over the mouth of the wearer, the tented region being open at the lower edge of the panel to allow escape of body fluids; and a fold-forming strip of material secured between opposing, spaced portions of the inner face of the panel in the central region to hold the central region in a folded condition.

15. The mask as claimed in claim 14, wherein the fold forming strip is elastic.

16. A protective mask for resisting biting by a detainee, the mask comprising:

a panel of flexible, breathable material shaped to extend across and cover the nose, mouth and cheeks of a wearer;

the panel having an upper edge for extending across the bridge of a wearer's nose, a lower edge for locating at or below a wearer's chin, opposite sides for positioning adjacent the ears of the wearer, an inner face for facing towards a wearer's face, and an outer face;

at least one fastener strap extending between the opposite sides of the panel for extending around the back of a wearer's head in order to secure the panel in position across a wearer's face; and an elongate strip member secured to the central region of the inner face of the panel oriented to extend transversely across the mouth of a wearer and resisting biting by the wearer through the panel.

17. The mask as claimed in claim 16, wherein the strip member is of sponge rubber material.

18. The mask as claimed in claim 16, wherein two spaced straps extend from opposite sides of the panel, one strap being located above the ears of a wearer and the other strap being located below the ears of a wearer when the mask is worn.

19. The mask as claimed in claim 18, wherein the straps are secured together at a central region located behind the wearer's head when the mask is worn.

20. The mask as claimed in claim 16, wherein the lower edge of the mask is free when the mask is worn to provide an opening for exit of body fluids excreted from the wearer's mouth or nose during use of the mask.

21. The mask as claimed in claim 16, wherein a vertically extending fold is formed in a central region of the mask, the fold extending down to the lower edge of the mask to provide a fluid exit opening from the mask.

22. The mask as claimed in claim 21, including an elastic strip secured between opposing inner portions of the central region of the mask to form the fold.

23. A combination security mask and carrying pouch assembly, comprising:

a protective mask comprising a panel of flexible, breathable material shaped to extend across and cover the nose, mouth and cheeks of a wearer, at least one fastener strap for extending from the panel around the back of a wearer's head for securing the panel in position across a wearer's face, and an elongate strip member secured to the central region of the inner face of the panel oriented to extend transversely across the mouth of a wearer and resist biting by the wearer through the panel, the mask being foldable into a compact configuration for storage purposes; and a pouch having a pocket of predetermined dimensions for receiving the mask when in its folded, compact configuration, and a ring secured to the pouch for securing it to a key ring or belt loop.

* * * * *